US007628210B2

(12) United States Patent
Avant et al.

(10) Patent No.: US 7,628,210 B2
(45) **Date of Patent: *Dec. 8, 2009**

(54) BALL SEAT HAVING BALL SUPPORT MEMBER

(75) Inventors: Marcus A. Avant, Kingwood, TX (US); Charles C Johnson, League City, TX (US); James G. King, Kingwood, TX (US); David B. Ruddock, Pearland, TX (US)

(73) Assignee: Baker Hughes Incorporated, Houston, TX (US)

( * ) Notice: Subject to any disclaimer, the term of this patent is extended or adjusted under 35 U.S.C. 154(b) by 267 days.

This patent is subject to a terminal disclaimer.

(21) Appl. No.: 11/891,706

(22) Filed: Aug. 13, 2007

(65) Prior Publication Data

US 2009/0044948 A1 Feb. 19, 2009

(51) Int. Cl.
*E21B 34/06* (2006.01)

(52) U.S. Cl. ..... 166/373; 166/318

(58) Field of Classification Search ..... 166/193, 166/194, 373, 318; 137/68.16; 251/172, 251/175

See application file for complete search history.

(56) References Cited

U.S. PATENT DOCUMENTS 1,883,071 A * 10/1932 Stone ..... 166/194
2,769,454 A 11/1956 Bletcher et al.
2,822,757 A 2/1958 Coberly
2,973,006 A 2/1961 Nelson
3,007,527 A 11/1961 Nelson
3,013,612 A 12/1961 Angel
3,211,232 A 10/1965 Grimmer (Continued)

FOREIGN PATENT DOCUMENTS

GB 2281924 A 3/1995
WO WO 00/15943 3/2000

OTHER PUBLICATIONS

Notification of Transmittal of the International Search Report and the Written Opinion of the International Searching Authority, Or the Declaration, Feb. 11, 2009, pp. 1-4, PCT/US2008/072732, Korean Intellectual Property Office.

(Continued)

*Primary Examiner*—David J Bagnell
*Assistant Examiner*—Cathleen R Hutchins
(74) *Attorney, Agent, or Firm*—Greenberg Traurig LLP; Anthony F. Matheny

(57) ABSTRACT

Apparatuses for restricting fluid flow through a well conduit comprise a housing having a longitudinal bore and a seat disposed within the bore. The seat has a first position when the apparatus is in the run-in position and a second position when the apparatus is in the set position. A plug element support member has a retracted position when the apparatus is in the run-in position and an extended position when the apparatus is in the set position. A plug element adapted to be disposed into the bore and landed on the seat to restrict fluid flow through the bore and the well conduit is used to move the plug element support member from the retracted position to the extended position, thereby providing support to the plug member landed on the seat.

18 Claims, 3 Drawing Sheets

U.S. PATENT DOCUMENTS

| | | | | |
|---|---|---|---|---|
| 3,510,103 | A | | 5/1970 | Carsello |
| 3,566,964 | A | | 3/1971 | Livingston |
| 3,667,505 | A | | 6/1972 | Radig |
| 3,727,635 | A | | 4/1973 | Todd |
| 3,901,315 | A | | 8/1975 | Parker et al. |
| 4,160,478 | A | | 7/1979 | Calhoun et al. |
| 4,291,722 | A | | 9/1981 | Churchman |
| 4,390,065 | A | | 6/1983 | Richardson |
| 4,448,216 | A | | 5/1984 | Speegle et al. |
| 4,478,279 | A | | 10/1984 | Puntar et al. |
| 4,510,994 | A | * | 4/1985 | Pringle ..... 166/156 |
| 4,537,383 | A | | 8/1985 | Fredd |
| 4,576,234 | A | | 3/1986 | Upchurch |
| 4,583,593 | A | | 4/1986 | Zunkel et al. |
| 4,669,538 | A | | 6/1987 | Szarka |
| 4,826,135 | A | | 5/1989 | Mielke |
| 5,056,599 | A | | 10/1991 | Comeaux et al. |
| 5,244,044 | A | * | 9/1993 | Henderson ..... 166/318 |
| 5,297,580 | A | | 3/1994 | Thurman |
| 5,704,393 | A | | 1/1998 | Connell et al. |
| 5,762,142 | A | | 6/1998 | Connell et al. |
| 5,813,483 | A | | 9/1998 | Latham et al. |
| 5,960,881 | A | | 10/1999 | Allamon et al. |
| 6,050,340 | A | | 4/2000 | Scott |
| 6,155,350 | A | | 12/2000 | Melenyzer |
| 6,293,517 | B1 | | 9/2001 | Cunningham |
| 6,530,574 | B1 | | 3/2003 | Bailey et al. |
| 6,547,007 | B2 | | 4/2003 | Szarka et al. |
| 6,634,428 | B2 | | 10/2003 | Krauss et al. |
| 6,666,273 | B2 | | 12/2003 | Laurel |
| 6,668,933 | B2 | | 12/2003 | Kent |
| 6,834,726 | B2 | | 12/2004 | Giroux et al. |
| 6,866,100 | B2 | | 3/2005 | Gudmestad et al. |
| 6,896,049 | B2 | | 5/2005 | Moyes |
| 7,150,326 | B2 | | 12/2006 | Bishop et al. |
| 7,503,392 | B2 | | 3/2009 | King et al. |
| 2005/0061372 | A1 | | 3/2005 | McGrath et al. |
| 2005/0126638 | A1 | | 6/2005 | Gilbert |
| 2005/0205264 | A1 | | 9/2005 | Starr et al. |
| 2006/0175092 | A1 | | 8/2006 | Mashburn |
| 2006/0213670 | A1 | | 9/2006 | Bishop et al. |
| 2006/0243455 | A1 | | 11/2006 | Telfer et al. |
| 2007/0023087 | A1 | | 2/2007 | Krebs et al. |
| 2008/0066924 | A1 | | 3/2008 | Xu |
| 2008/0217025 | A1 | | 9/2008 | Ruddock et al. |
| 2009/0044946 | A1 | | 2/2009 | Schasteen et al. |
| 2009/0044955 | A1 | | 2/2009 | King et al. |

OTHER PUBLICATIONS

International Search Report, Feb. 11, 2009, pp. 1-3, PCT/US2008/072732, Korean Intellectual Property Office.

Written Opinion of the International Searching Authority, Feb. 11, 2009, pp. 1-3, PCT/US2008/072732, Korean Intellectual Property Office.

Notification of Transmittal of the International Search Report and the Written Opinion of the International Searching Authority, Or the Declaration, Feb. 11, 2009, pp. 1-4, PCT/US2008/072734, Korean Intellectual Property Office.

International Search Report, Feb. 11, 2009, pp. 1-3, PCT/US2008/072734, Korean Intellectual Property Office.

Written Opinion of the International Searching Authority, Feb. 11, 2009, pp. 1-4, PCT/US2008/072734, Korean Intellectual Property Office.

Notification of Transmittal of the International Search Report and the Written Opinion of the International Searching Authority, Or the Declaration, Feb. 11, 2009, pp. 1-4, PCT/US2008/072735, Korean Intellectual Property Office.

International Search Report, Feb. 11, 2009, pp. 1-3, PCT/US2008/072735, Korean Intellectual Property Office.

Written Opinion of the International Searching Authority, Feb. 11, 2009, pp. 1-4, PCT/US2008/072735, Korean Intellectual Property Office.

Notification of Transmittal of the International Search Report and the Written Opinion of the International Searching Authority, Or the Declaration, Jan. 19, 2009, pp. 1-4, PCT/US2008/072470, Korean Intellectual Property Office.

International Search Report, Jan. 19, 2009, pp. 1-3, PCT/US2008/072470, Korean Intellectual Property Office.

Written Opinion of the International Searching Authority, Jan. 19, 2009, pp. 1-3, PCT/US2008/072470, Korean Intellectual Property Office.

Office Action dated Jul. 16, 2008 in U.S. Appl. No. 11/891,713 U.S. Patent and Trademark Office, U.S.A.

StageFRAC Maximize Reservoir Drainage, 2007, pp. 1-2, Schlumberger, U.S.A.

Brad Musgrove, Multi-Layer Fracturing Solution Treat and Produce Completions, Nov. 12, 2007, pp. 1-23, Schlumberger, U.S.A.

G.L. Rytlewski, A Study of Fracture Initiation Pressures in Cemented Cased-Hole Wells Without Perforations, May 15, 2006, pp. 1-10, SPE 100572, Society of Petroleum Engineers, U.S.A.

Response to Office Action dated Oct. 15, 2008, in U.S. Appl. No. 11/891,713, U.S. Patent and Trademark Office, U.S.A.

Notice of Allowance & Fees Due and Notice of Allowability dated Jan. 5, 2009, in U.S. Appl. No. 11/891,713, U.S. Patent and Trademark Office, U.S.A.

Office Action dated Apr. 9, 2009, in U.S. Appl. No. 11/891,715, U.S. Patent and Trademark Office, U.S.A.

Response to Restriction Requirement dated Apr. 22, 2009, in U.S. Appl. No. 11/891,715, U.S. Patent and Trademark Office, U.S.A.

Office Action dated Jun. 19, 2009, in U.S. Appl. No. 11/891,715, U.S. Patent and Trademark Office, U.S.A.

Office Action dated Jul. 6, 2009, in U.S. Appl. No. 12/317,647, U.S. Patent and Trademark Office, U.S.A.

Summary of Examiner Interview dated Aug. 6, 2009, in U.S. Appl. No. 12/317,647, U.S. Patent and Trademark Office, U.S.A.

Amendment in Response to Office Action dated Aug. 10, 2009, in U.S. Appl. No. 12/317,647, U.S. Patent and Trademark Office, U.S.A.

Amendment in Response to Office Action dated Aug. 10, 2009, in U.S. Appl. No. 11/891,714, U.S. Patent and Trademark Office, U.S.A.

Amendment in Response to Office Action dated Aug. 10, 2009, in U.S. Appl. No. 11/891,715, U.S. Patent and Trademark Office, U.S.A.

* cited by examiner

BALL SEAT HAVING BALL SUPPORT MEMBER

BACKGROUND

1. Field of Invention

The present invention is directed to ball seats for use in oil and gas wells and, in particular, to ball seats having a ball seat support member that provides support to the ball in addition to the support provided by the seat.

2. Description of Art

Ball seats are generally known in the art. For example, typical ball seats have a bore or passageway that is restricted by a seat. The ball or drop plug is disposed on the seat, preventing or restricting fluid from flowing through the bore of the ball seat and, thus, isolating the tubing or conduit section in which the ball seat is disposed. As the fluid pressure above the ball or drop plug builds up, the conduit can be pressurized for tubing testing or actuating a tool connected to the ball seat such as setting a packer. Ball seats are also used in cased hole completions, liner hangers, flow diverters, frac systems, and flow control equipment and systems.

Although the terms "ball seat" and "ball" are used herein, it is to be understood that a drop plug or other shaped plugging device or element may be used with the "ball seats" disclosed and discussed herein. For simplicity it is to be understood that the term "ball" includes and encompasses all shapes and sizes of plugs, balls, or drop plugs unless the specific shape or design of the "ball" is expressly discussed.

As mentioned above, all seats allow a ball to land and make a partial or complete seal between the seat and the ball during pressurization. The contact area between the ball and the inner diameter of the seat provides the seal surface. Generally, the total contact area or bearing surface between the ball and the seat is determined by the outer diameter of the ball and the inner diameter of seat. The outer diameter of the contact area is determined by the largest diameter ball that can be transported down the conduit. The inner diameter of the seat is determined by the allowable contact stress the ball can exert against the contact area and/or the required inner diameter to allow preceding passage of plug elements or tools, and/or subsequent passage of tools after the plug element is removed, through the inner diameter of the seat.

The seat is usually made out of a metal that can withstand high contact forces due to its high yield strength. The ball, however, is typically formed out of a plastic material that has limited compressive strength. Further, the contact area between the ball and seat is typically minimized to maximize the seat inner diameter for the preceding passage of balls, plug elements, or other downhole tools. Therefore, as the ball size becomes greater, the contact stresses typically become higher due to the increasing ratio of the cross-section of the ball exposed to pressure compared to the cross-section of the ball in contact with the seat. This higher contact pressure has a propensity to cause the plastic balls to fail due to greater contact stresses.

The amount of contact pressure a particular ball seat can safely endure is a direct function of the ball outer diameter, seat inner diameter, applied tubing pressure, and ball strength. Because of limited ball strength as discussed above, the seat inner diameter is typically reduced to increase the contact area (to decrease contact stress). The reduced seat inner diameter forces the ball previously dropped through the seat inner diameter to have a smaller outer diameter to pass through this seat inner diameter. This reduction in outer diameter of the previous balls continues throughout the length of conduit until ball seats can no longer be utilized. Therefore, a string of conduit is limited as to the number of balls (and, thus ball seats) that can be used which reduces the number of actuations that can be performed through a given string of conduit.

SUMMARY OF INVENTION

Broadly, ball seats having a housing, a seat, and a plug element such as a ball are disclosed. Typically, the ball is landed and the conduit is pressurized to a predetermined pressure. Upon pressurization of the conduit so that the ball is pushed into the seat, the plug element support member extends from its retracted position, i.e., the position in which the plug element support member is not touching or otherwise in engagement with the ball, and into the bore of the ball seat to engage with, and provide additional support to, the ball as it is being pressurized. In other words, the force of the ball into the seat by the pressure in the tubing causes the seat to move the plug element support member inward into the bore of the ball seat from its retracted position toward the centerline (or axis) of the bore of the ball seat and into its extended positions, thus either making contact with the previously unsupported area of the ball or otherwise distributing the force acting on the ball over a larger surface area so that the ball and seat can withstand higher pressures and/or restrict movement of the ball through the seat inner diameter as the pressure begins to deform and extrude the ball through the seat.

By making contact with, or engaging, the ball, the plug element support members provide support for the ball because the resulting force against the ball caused by pressurization of the ball against the seat is spread out between the existing seat contact area and the additional contact area provided by the extended plug element support member. As the pressure is increased, the force on the ball is transferred to both the original seal area of the seat and to the plug element support member. The applied pressure to the plug element support member, therefore, decreases the likelihood that the force on the ball will push the ball through the seat.

Due to the plug element support member providing additional support to the ball, the ball seats disclosed herein provide a plugging method where higher pressure can be exerted onto a seat by a lower strength ball without exceeding the ball's bearing or load strength. Further, the contact pressure resulting from having additional contact area provided by the plug element support members will be effectively reduced without affecting the sealability of the ball. Thus, more sizes of balls in closer increments can be utilized in various applications such as in frac ball systems. Additionally, more balls can be used because the seat inner diameter of subsequent seats can be larger due to the seat inner diameter of the seats of each ball seat in the conduit being larger. This allows more balls to go through the conduit because the seat inner diameters are larger throughout the length of conduit. Because more balls or plug elements can travel through the frac ball systems, more producible zones can be isolated by a single frac ball system.

Thus, additional contact area is provided by the plug element support member that allows a greater pressure to be exerted onto the ball while keeping the original seat inner diameter the same or, alternatively, allows a larger seat inner diameter without requiring a reduction in the pressure acting on the ball to prevent the ball from failing. The additional contact area also allows the contact pressure resulting from the tubing pressure onto the ball to be distributed to the standard seat contact area between the seat and the ball and the new contact areas between the engagement surface of the plug element support member and the ball, i.e., the surface of the plug element support member that engages with the ball.

In one embodiment, an apparatus for restricting flow through a well conduit is disclosed. The apparatus has a run-in position and a set position and comprises a housing having a longitudinal bore and a seat disposed within the bore, the seat having a first position when the apparatus is in the run-in position and a second position when the apparatus is in the set position; a plug element support member disposed below the seat, the plug element support member having a retracted position when the apparatus is in the run-in position and an extended position when the apparatus is in the set position; and a plug element adapted to be disposed into the bore and landed on the seat to restrict fluid flow through the bore and the well conduit and to cause the plug element support member to move from the retracted position to the extended position thereby providing support to the plug member landed on the seat.

A further feature of the apparatus is that the plug element may be a ball and the plug element support member is a c-ring. Another feature of the apparatus is that the plug element support member may be a conically-shaped slidable sleeve. An additional feature of the apparatus is that the plug element support element member may be in sliding engagement with at least one ramp surface. Still another feature of the apparatus is that the seat may be in sliding engagement with an inner wall surface of the bore of the apparatus and is initially held in the first position by a shear screw disposed in the housing. A further feature of the apparatus is that the plug element support member and the seat may be a single structure in sliding engagement with a ramp surface disposed along an inner wall surface of the housing bore. Another feature of the apparatus is that the plug element support member may be a c-ring slidingly engaged with the ramp. An additional feature of the apparatus is that the plug element support member may restrict an inner diameter of the bore when in the extended position. Still another feature of the apparatus is that the housing may include an upwardly biased member disposed below the seat to facilitate returning the seat to the first position and the plug element support member to the retracted position.

In another embodiment, an apparatus for restricting flow through a well conduit is disclosed. The apparatus having a run-in position and a set position and comprises a housing having a longitudinal bore with a seat engagement surface disposed on an inner wall surface of the bore; a seat slidingly engaged with the seat engagement surface, the seat having a first position when the apparatus is in the run-in position and a second position when the apparatus is in the set position; and a plug element adapted to be disposed into the bore and landed on the seat to restrict fluid flow through the bore and the well conduit and to cause the seat to move from the first position to the second position thereby causing the seat to restrict an inner diameter of the bore when the plug element is landed on the seat, wherein movement of the seat from the first position to the second position causes a plug element support member to engage with and support the plug element.

A further feature of the apparatus is that the seat may be a c-ring. Another feature of the apparatus is that the c-ring may be a conically-shaped slidable sleeve. An additional feature of the apparatus is that the seat may comprise a variable contact area for engagement with the plug element, the seat having a first contact area for engagement with the plug element in the first position and a second contact area for engagement with the plug element in the second position, the first contact area being smaller than the second contact area so that the second contact area is the plug element support member. Still another feature of the apparatus is that the plug element support member and the seat may be separate structures operatively associated with each other. A further feature of the apparatus is that the seat may comprise a housing engagement surface, a plug element engagement surface, and a plug element support member engagement surface, the housing engagement surface in sliding engagement with the seat engagement surface, the plug element engagement surface in sealing engagement with the plug element when landed on the seat, and the plug element support member engagement surface being in sliding engagement with the plug element support member, wherein movement of the seat from the first position to the second position causes the housing engagement surface to slide along the seat engagement surface, and the plug element support member to slide along the plug element support member engagement surface to move the plug element support member from a retracted position to an extended position. Another feature of the apparatus is that the housing may further comprise a housing plug element support member engagement surface in sliding engagement with the plug element support member, wherein movement of the seat from the first position to the second position causes the plug element support member to slide along the housing plug element support member engagement surface to move the plug element support member from the retracted position to the extended position. An additional feature of the apparatus is that the housing may include an upwardly biased member disposed below the seat to facilitate returning the seat to the first position and the plug element support member to the retracted position.

In an additional embodiment, a method of actuating a downhole tool disposed in the wellbore of a well is disclosed. The method comprises the steps of: (a) providing a seat disposed within a housing having a longitudinal bore, the seat comprising a plug contact area and a plug element support member, the seat having a first position and a second position; (b) lowering the seat and a downhole tool on a string of conduit into a wellbore of a well; (c) inserting a plug member into the conduit and landing the plug member on the plug contact area of the seat to move the seat from the first position to the second position causes restriction of fluid flow through the conduit; (d) moving the plug element support member from a retracted position to an extended position allowing the plug element to engage the plug element support member; (e) pumping fluid into the conduit forcing the plug element into the seat; and (f) actuating the well tool by fluid pressure within the conduit.

A further feature of the method is that step (e) may be performed prior to step (d) so that pumping fluid into the conduit moves the plug element support member from the retracted position to the extended position until the plug element support member engages the plug element to provide support to the plug element. Another feature of the method is that the method may further comprise the step of reducing the pressure in the conduit after step (f) thereby causing the seat to move from the second position to the first position and, thus, causing the plug element support member to move from the extended position to the retracted position.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
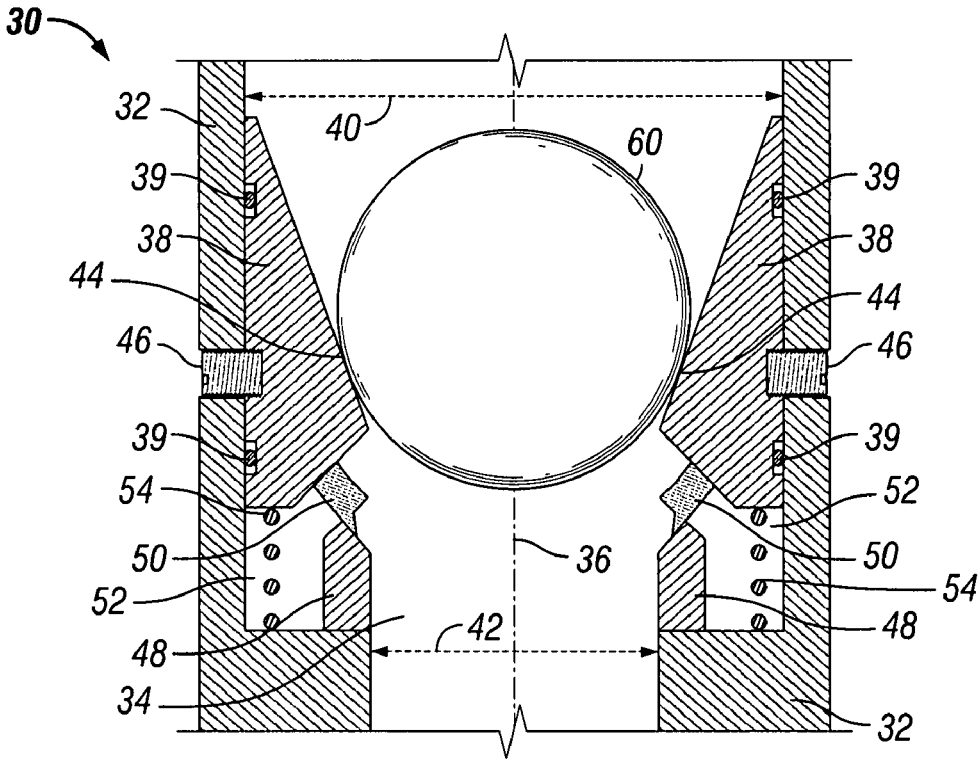
FIG. 1 is a partial cross-sectional view of a specific embodiment of a ball seat disclosed herein shown in the run-in position.
Figure 2:
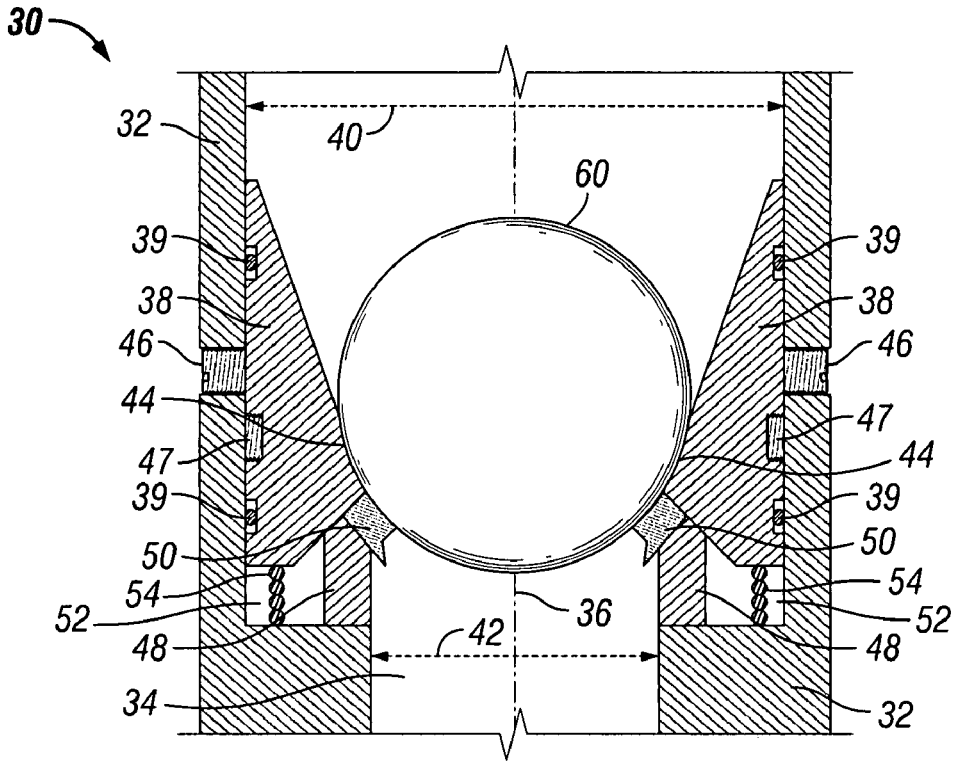
FIG. 2 is a partial cross-sectional view of the ball seat shown in FIG. 1 shown in the actuated or set position.

Referring now to FIGS. 1-2, in one embodiment, ball seat 30 includes a sub or housing 32 having bore 34 defined by an inner wall surface and having axis 36. Bore 34 includes seat 38 for receiving plug element 60, shown as a ball in FIGS. 1-2. Seat 38 includes a housing engagement surface in sliding engagement with the inner wall surface of housing 32 (also referred to herein as a seat engagement surface) so that seat 38 has a first position (FIG. 1) and a second position (FIG. 2). In one embodiment, dynamic seals 39 assist in sliding engagement of seat 38 with the inner wall surface of housing 32. Seat 38 also includes contact area 44 for receiving plug element 60. Contact area 44 is shaped to form an engagement surface with plug element 60 that is reciprocal in shape to the shape of the plug element 60 (shown in FIGS. 1-2 as a ball). Thus, in this embodiment, plug element 60 is spherically-shaped and contact area 44 includes an arc shape. As mentioned above, however, although plug element 60 is shown as a ball in FIGS. 1-2, it is to be understood that plug element 60 may be a drop plug, dart, or any other plug element known to persons of ordinary skill in the art.

As illustrated in FIGS. 1-2, bore 34 has bore inner diameter 40 disposed above seat 38 that is larger than the bore inner diameter 42 disposed below seat 38. Inner diameter 40 is also referred to as the "outer diameter of the contact area," and inner diameter 42 is also referred to as the "seat inner diameter" or "inner diameter of the seat." Therefore, the outer diameter of contact area 44 is defined by inner diameter 40 and the inner diameter of contact area 44 is defined by inner diameter 42. Attachment members such as threads (not shown) can be disposed along the outer diameter of housing 32 or along the inner wall surface of bore 34 at the upper and lower ends of housing 32 for securing ball seat 30 into a string of conduit, such as drill pipe or tubing.

Housing 32 can include one or more shear screws 46 for initially maintaining seat 38 in the run-in position (FIG. 1). In the embodiment shown in FIGS. 1-2, housing 32 also includes ramp member 48 having a ramp surface in sliding engagement with plug element support member 50, also referred to herein as a housing plug element support member engagement surface. In one particular embodiment, ramp member 48 forms a slot or groove 52 within housing 32. Slot 52 can include an upwardly biased member 54, such as a coiled spring (shown in FIGS. 1-2) or an elastomer or rubber element, or belleville springs (also known as belleville washers). Upwardly biased member 54 facilitates movement of seat 38 from its set position (FIG. 2) back to the run-in position (FIG. 1) when plug element 60 is no longer being forced into seat 38.

Plug element support member 50 is operatively associated with seat 38 and ramp member 48. In one embodiment, plug element support member 50 is in sliding engagement with a plug element support member engagement surface disposed on seat 38 and with the housing plug element support member engagement surface of ramp member 48. Plug element support member 50 includes a retracted position (FIG. 1) and a plurality of extended positions, the fully extended position being shown in FIG. 2 in which plug element support member 50 engages plug element 60. In one specific embodiment, plug element support member 50 is a c-ring to facilitate movement of plug element support member 50 from the retracted position (FIG. 1) to the extended positions (e.g., FIG. 2). As will be recognized by persons skilled in the art, in the embodiment in which plug element support member 50 is a c-ring, plug element support member 50 does not completely seal flow around plug element 60. In this embodiment, the primary sealing area is defined by contact area 44 and the engagement of plug element 60 with plug element support member 50 provides a secondary sealing area. In certain embodiments, discussed in greater detail below, the sealing area between plug element 60 and plug element support member 50 is sufficient to allow the necessary pressurization of fluid above plug element 60 despite a certain amount of leakage between plug element 60 and plug element support member 50. In this embodiment, however, the primary sealing area defined by contact area 44 is sufficient to allow the appropriate pressurization above plug element 50.

In one operation of this embodiment, ball seat 30 is disposed in a string of conduit with a downhole tool (not shown), such as a packer or a bridge plug located above ball seat 30. The string of conduit is run-in a wellbore until the string is located in the desired position. Plug element 60 is dropped down the string of conduit and landed on seat 38. Initially, the only contact area for plug element 60 with seat 38 is contact area 44. Fluid, such as hydraulic fluid, is pumped down the string of conduit causing downward force or pressure to act on plug element 60. When the pressure or downward force of the fluid above seat 38 reaches a certain, usually predetermined, pressure, shear screws 46 shears freeing seat 38 to move downward from its first position (FIG. 1) to its second position (FIG. 2). As shown in FIG. 2, a portion 47 of shear screw moves downward with seat 38.

As the pressure of the fluid increases against plug element 60 and, thus, seat 38, seat 38 moves downward, upwardly biased member 54 is compressed within slot 52, and plug element support member 50 is moved downward and inward until it is moved from its retracted position (FIG. 1) to its fully extended position (FIG. 2. In its fully extended position, plug element support member 50 engages and supports plug element 60.

In the embodiment shown in FIGS. 1-2, plug element support member 50 slides along the housing plug element support member engagement surface of ramp member 48 and along a plug element support member engagement surface of seat 38 causing movement of plug element support member 50 downward and inward toward axis 34. In so doing, the plug element engagement surface of plug element support member 50 engages with plug element 60 to provide support to plug element 60 in addition to the support provided by contact area 44. Thus, the amount of support of plug element 60 is increased from contact area 44 to contact area 44 plus the engagement surface area provided by plug element support member 50. Further, in this embodiment, plug element support member 50 restricts a portion of bore 34 below seat 38. In other words, a portion of bore 34 has an inner diameter less than inner diameter 42.

After actuation of a downhole tool by the increased pressure of the fluid above plug element 60, or after the increased pressure of the fluid above plug element 60 has been used for its intended purpose, fluid is no longer pumped down the string of conduit. As a result, the downward force caused by the pressurization of the fluid above plug element 60 decreases until the upward force of upward biased member 54, either alone or in combination with hydrostatic pressure below plug element 60, overcomes the downward force of the fluid above plug element 60. Due to the upward force on plug element 60 overcoming the downward force on plug element 60, seat 38 and plug element 60 are forced upward which, in turn, allows plug element support member 50 to move from the extended position (FIG. 2) to the retracted position (FIG. 1).

Subsequently, plug element 60 can be removed through methods and using devices known to persons of ordinary skill in the art, e.g., milling, dissolving, or fragmenting plug element 60 or by forcing plug element 60 through seat 38 using force that is sufficient to force plug element 60 through seat 38, but insufficient to move plug element support member 44 from the retracted position to the extended position. Alternatively, plug element 60 may be a lightweight "float" plug element such that, when pressure is reduced, plug element 60 is permitted to float up to the top of the well.

Figure 3:
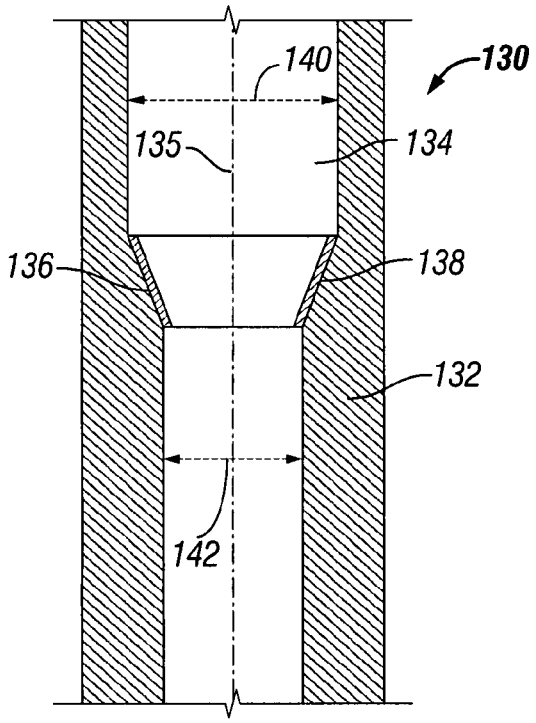
FIG. 3 is a partial cross-sectional view of another specific embodiment of a ball seat disclosed herein shown in the run-in position.
Figure 4:
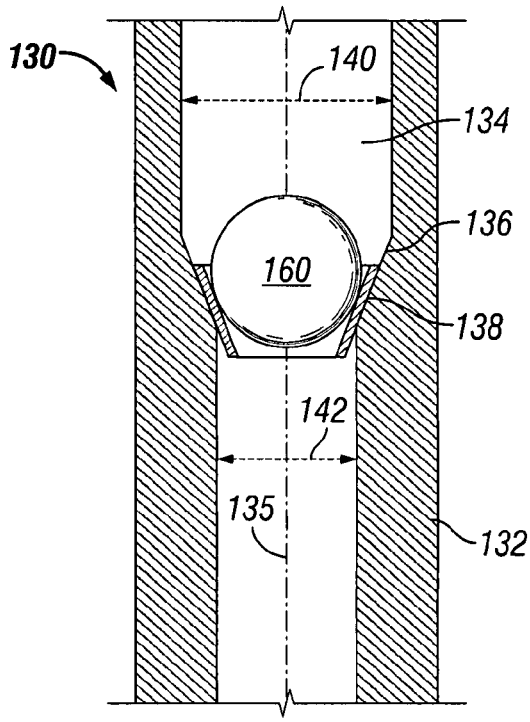
FIG. 4 is a partial cross-sectional view of the ball seat shown in FIG. 3 shown in the actuated or set position.
Figure 5:
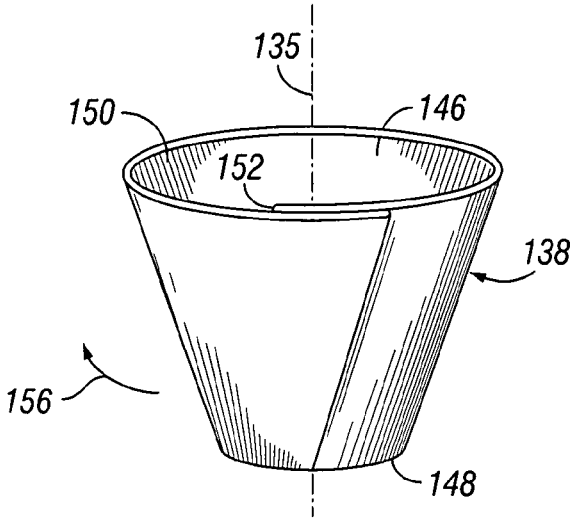
FIG. 5 is a perspective view of the seat in the embodiment shown in FIGS. 3-4.

Referring now to FIGS. 3-5, in another embodiment ball seat 130 includes housing 132 having longitudinal bore 134 with axis 135. The inner wall surface of bore 134 includes ramp 136. Ramp 136 is conically-shaped and includes seat 138 operatively associated therewith. Bore 134 is divided into two portions. One portion is disposed above ramp 136 and is defined by inner diameter 140. The other portion is disposed below ramp 136 and is defined by inner diameter 142. Attachment members such as threads (not shown) can be disposed along the outer diameter of housing 132 or along the inner wall surface of bore 134 at the upper and lower ends of housing 132 for securing ball seat 130 into a string of conduit, such as drill pipe or tubing.

As best illustrated in FIG. 5, seat 138 is a c-ring, and in particular a conically-shaped sleeve c-ring having upper opening 146, lower opening 148, inner surface 150 and inner edge 152. Inner edge 152 is slidable over inner surface 150 in the direction of arrow 156 around axis 135 so that seat 138 can move from its retracted position (FIG. 3) to its extended position (FIG. 4). When seat 138 is in the extended position (FIG. 4), lower opening 148 is restricted and can be closed (partially or completely), i.e., made smaller, by seat 138 wrapping around plug element 160, inner edge 152 sliding along inner surface 150 in the direction of arrow 156, and seat 138 sliding down ramp 136. In so doing, inner diameter 142 of bore 134 is restricted by seat 138 and seat 138 provides more support to plug element 160 as compared to the amount of support solely provided by ramp 136.

In one specific embodiment, a shoulder is disposed within bore 134 above seat 138 to assist in maintaining seat 138 in contact with ramp 136. In other embodiments, seat 138 is partially connected to ramp 136 so that inner edge 152 is slidable over inner surface 150 in the direction of arrow 156 to sufficiently close lower opening 148, however, seat 138 maintains contact with ramp 136.

In another specific embodiment, seat 138 is formed from a metal sheath material. In another embodiment, seat 138 is formed from a shape-memory material.

In one embodiment of the operation of this embodiment, ball seat 130 is placed in a string (not shown) with a downhole tool (not shown), such as a packer or a bridge plug located above. The string is run into the wellbore to the desired location. Plug element 160 is dropped down the string, into bore 134 of housing 132, and landed on seat 138. Alternatively, plug element 160 may be placed in housing 132 before running. The operator pumps fluid into the string. When landed on seat 138, plug element 160 causes inner edge 152 to slide along inner surface 150 in the direction of arrow 156 and, thus, seat 138 slips, tightens, or wraps around plug element 160. As a result, lower opening 148 below plug element 160 is restricted, e.g., closed or collapsed, and fluid flow through inner diameter 142 of bore 134 is restricted. Because of the restriction of flow through inner diameter 142 of bore 134 by seat 138, plug element 160 is provided greater support by seat 138 as compared to seats that do not restrict inner diameter 142 of bore 134. Additionally, although seat 138 has a leak path along inner edge 152, seat 138 can be designed so that plug element 160 forms a seal against the seat 138 sufficient to allow fluid (not shown) to build up above plug element 160 until the pressure is sufficiently great to actuate the downhole tool or perform whatever procedures are desired. Due to the additional contact area between plug element 160 and seat 138, and the restriction of inner diameter 142 by collapsing or closing (partially or completely) lower opening 148 below seat 138, higher fluid pressures can be exerted on plug element 160 to actuate the downhole tool, even though some leakage may occur.

After the downhole tool is actuated, plug element 160 can be removed from seat 138 so fluid can again flow through the string. In one embodiment, removal of plug element 160 can be accomplished by decreasing the wellbore fluid pressure such that seat 138 is moved from its extended position (FIG. 4) to its retracted position (FIG. 3), such as where seat 138 is formed out of a shape-memory material. The return of seat 138 to its initial or first position (FIG. 4) unwraps plug element 160, i.e., by inner edge 152 sliding along inner surface 150 in a direction opposite that of the direction of arrow 156, so that it can be released from seat 138. In one embodiment, plug element 60 is a lightweight "float" plug element such that, when pressure is reduced and plug element 60 is freed from seat 138, plug element 160 is permitted to float up to the top of the well.

Alternatively, plug element 160 can be removed through methods and using devices known to persons of ordinary skill in the art, e.g., milling, dissolving, or fragmenting plug element 160 or by forcing plug element 160 through seat 138 using sufficient force to extrude plug element 160 through lower opening 148.

Figure 6:
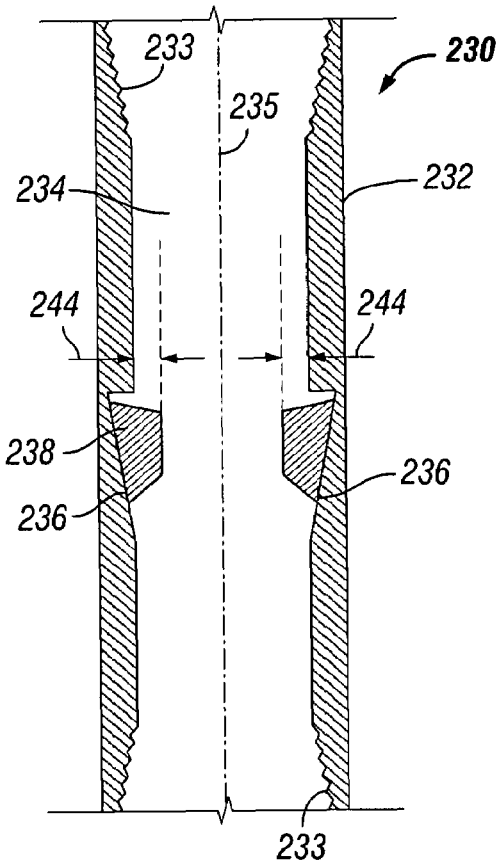
FIG. 6 is a partial cross-sectional view of an additional specific embodiment of a ball seat disclosed herein shown in the run-in position.
Figure 7:
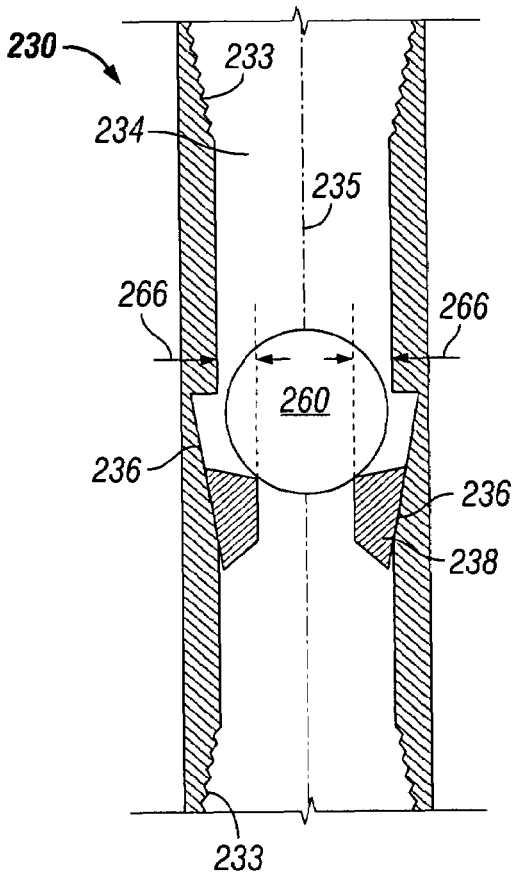
FIG. 7 is a partial cross-sectional view of the ball seat shown in FIG. 5 shown in the actuated position.

Referring now to FIGS. 6-7, in another embodiment, ball seat 230 includes a sub or housing 232 having bore 234 defined by an inner wall surface and having axis 235. Bore 234 includes seat 238 for receiving plug element 260, shown as a ball in FIG. 7. Seat 238 is in sliding engagement with the inner wall surface of housing 232 so that seat 238 has a first position (FIG. 6) and a second position (FIG. 7). Seat also includes contact area 244 for receiving plug element 260. Contact area 244 may be shaped to form an engagement surface with plug element 260 that is reciprocal in shape to the shape of plug element 260 (shown in FIG. 7 as a ball). Thus, in such an embodiment, plug element 260 is spherically-shaped and contact area 244 includes an arc shape (not shown). As mentioned above, however, although plug element 260 is shown as a ball in FIG. 6, it is to be understood that plug element 260 may be a drop plug, dart, or any other plug element known to persons of ordinary skill in the art.

Attachment members such as threads can be disposed along the outer diameter of housing 232 or along the inner wall surface of bore 234 (shown as threads 233 in FIGS. 6-7) at the upper and lower ends of housing 232 for securing ball seat 230 into a string of conduit, such as drill pipe or tubing.

The inner wall surface of bore 234 includes ramp 236. Ramp 236 is conically-shaped and includes seat 238 operatively associated therewith. In the embodiment shown in FIGS. 6-7, seat 238 is reciprocally shaped with ramp 236. In other words, seat 238 is conically-shaped. Further, seat 238 includes a housing engagement surface in sliding engagement with a seat engagement surface of ramp 236 such that as seat 238 is moved from its first position (FIG. 6) to its set position (FIG. 7), seat 238 is forced downward and inward toward axis 235. In so doing, contact area 244 on seat 238 increases from contact area 244 to contact area 266, thereby providing greater support to plug element 260. Because the contact area 244 of seat 238 is increased to contact area 266 plug member 260 engages a larger surface area of seat 238. This additional contact area, i.e., the difference between contact area 244 and contact area 266, is referred to herein as the "plug element support member." Thus, in this embodiment, seat 238 includes a plug element support member as part of its structure and, in the particular embodiment shown in FIGS. 6-7, plug element support member is formed integral with, i.e., as a whole with, seat 238.

In addition to moving seat 238 downward, the fluid pressure above plug member 260 also forces seat 238 inward toward axis 235. As a result, bore 234 below plug element 260 is restricted.

In one specific embodiment, seat 238 is a c-ring to facilitate movement of seat 238 from the retracted position (FIG. 6) to the extended positions (e.g., FIG. 7). As will be recognized by persons skilled in the art, in the embodiment in which seat 238 is a c-ring, seat 238 does not completely seal flow around plug element 260. In this embodiment, however, the sealing area between plug element 260 and seat 238 can be designed such that the c-ring extends sufficiently into bore 234 below plug element 260 to allow the necessary pressurization of fluid above plug element 260 despite a certain amount of leakage between plug element 260 and seat 238. C-ring shaped seat 238 may include a key to assist in drill out.

In other embodiments, seat 238 may be formed out of a compressible or otherwise malleable material that can be shaped to extend inward toward axis 235 when seat 238 is moved from its first position (FIG. 6) to its second position (FIG. 7). For example, seat 238 may be formed from a spirally wound flat strip of metal that shrinks up and tightens around plug element 260 when landed on or within seat 238.

In one embodiment of the operation of ball seat 230, ball seat 230 is placed in a string (not shown) with a downhole tool (not shown), such as a packer or a bridge plug located above. The string is run into the wellbore to the desired location. Plug element 260 is dropped down the string, into bore 234 of housing 232, and landed on seat 238, i.e., engaging contact area 244. Alternatively, plug element 260 may be placed in housing 232 before running. The operator pumps fluid into the string. When landed on seat 238, the fluid pressure above plug element 260 forces plug element 260 downward and, thus, seat 238 downward. Seat 238 slides downward and inward along ramp 236. As it moves, seat 238 extends inward toward axis 235, thereby increasing the area of engagement between plug member 260 and seat 238 from contact area 244 to contact area 266 and restricting the inner diameter of bore 234 below plug member 260. Because of the additional area of engagement provided by seat 238, i.e., the increase of contact between plug member 260 and seat 238 from contact area 244 to contact area 266, and the restriction of bore 234 below plug element 260, plug element 260 is provided greater support by seat 238 as compared to seats that are unable to move inward. Due to the additional contact area between plug element 260 and seat 238, and the restriction of bore 134 below plug element 260, higher fluid pressures can be exerted on plug element 160 to actuate the downhole tool, even though some leakage may occur.

After actuation of a downhole tool by the increased pressure of the fluid above plug element 260, or after the increased pressure of the fluid above plug element 260 has been used for its intended purpose, fluid is no longer pumped down the string of conduit. As a result, the downward force caused by the pressurization of the fluid above plug element 260 decreases until the upward force of hydrostatic pressure, either alone or in combination with the release of any energy stored in seat 238, such as where seat 238 is formed from a rubber or other elastomeric material that is compressible but returns to its original shape when the compressive forces are removed, overcomes the downward force of the fluid above plug element 260. Due to the upward force on plug element 260 and seat 238 overcoming the downward force on plug element 260 and seat 238, plug element 260 and seat 238 are forced upward until seat 238 is moved from its second position (FIG. 7) to its first position (FIG. 6). In so doing, bore 234 is no longer restricted and the area of engagement of plug element 260 with seat 238 returns toward contact area 244.

Subsequently, plug element 260 can be removed through methods and using devices known to persons of ordinary skill in the art, e.g., milling, dissolving, or fragmenting plug element 260 or by forcing plug element 260 through seat 238 using force that is sufficient to force plug element 260 through seat 238. Alternatively, plug element 260 may be a lightweight "float" plug element such that, when pressure is reduced, plug element 260 is permitted to float up to the top of the well.

It is to be understood that the invention is not limited to the exact details of construction, operation, exact materials, or embodiments shown and described, as modifications and equivalents will be apparent to one skilled in the art. For example, the size of each plug element support member can be any size or shape desired or necessary to be moved from the retracted position to the extended position to provide support to the plug element. Additionally, although the apparatuses described in greater detail with respect to FIGS. 1-7 are ball seats having a ball as their respective plug elements, it is to be understood that the apparatuses disclosed herein may be any type of seat known to persons of ordinary skill in the art that include at least one plug element support member. For example, the apparatus may be a drop plug seat, wherein the drop plug temporarily restricts the flow of fluid through the wellbore. Therefore, the term "plug" as used herein encompasses a ball as shown in FIGS. 1-7, as well as any other type of device that is used to restrict the flow of fluid through a ball seat. Further, in all of the embodiments discussed with respect to FIGS. 1-7, upward, toward the surface of the well (not shown), is toward the top of FIGS. 1-7, and downward or downhole (the direction going away from the surface of the well) is toward the bottom of FIGS. 1-7. However, it is to be understood that the ball seats may have their positions rotated. Accordingly, the ball seats can be used in any number of orientations easily determinable and adaptable to persons of ordinary skill in the art. Accordingly, the invention is therefore to be limited only by the scope of the appended claims.

What is claimed is:

1. An apparatus for restricting flow through a well conduit, the apparatus having a run-in position and a set position, the apparatus comprising:

a housing having a longitudinal bore and a seat disposed within the bore, the seat having a first position when the apparatus is in the run-in position and a second position when the apparatus is in the set position;

a plug element support member disposed below the seat and operatively associated with the seat, the plug element support member having a retracted position when the apparatus is in the run-in position and an extended position when the apparatus is in the set position, the retracted position defining a first diameter opening through the plug element support member and the extended position defining a second diameter opening through the plug element support member, the first diameter opening being greater than the second diameter opening; and a plug element adapted to be disposed into the bore and landed on the seat to restrict fluid flow through the bore and the well conduit and to cause the plug element support member to move from the retracted position to the extended position thereby contacting the plug element to provide support to the plug element.

2. The apparatus of claim 1, wherein the plug element is a ball and the plug element support member is a c-ring.

3. The apparatus of claim 1, wherein the plug element support member is a conically-shaped slidable sleeve.

4. The apparatus of claim 1, wherein the plug element support member is in sliding engagement with at least one ramp surface.

5. The apparatus of claim 1, wherein the seat is in sliding engagement with an inner wall surface of the bore of the apparatus and is initially held in the first position by a shear screw disposed in the housing.

6. The apparatus of claim 1, wherein the plug element support member comprises a c-ring in sliding engagement with a ramp surface disposed on an inner wall surface of the housing bore.

7. The apparatus of claim 1, wherein the housing includes an upwardly biased member disposed below the seat to facilitate returning the seat to the first position and the plug element support member to the retracted position.

8. An apparatus for restricting flow through a well conduit, the apparatus having a run-in position and a set position, the apparatus comprising:

a housing having a longitudinal bore with a seat engagement surface disposed on an inner wall surface of the bore;

a seat slidingly engaged with the seat engagement surface, the seat having a first position when the apparatus is in the run-in position and a second position when the apparatus is in the set position;

a plug element support member operatively associated with the seat, the plug element support member being disposed below the seat; and a plug element adapted to be disposed into the bore and landed on the seat to restrict fluid flow through the bore and the well conduit and to cause the seat to move from the first position to the second position thereby causing the seat to restrict an inner diameter of the bore when the plug element is landed on the seat, wherein movement of the seat from the first position to the second position causes the plug element support member to engage with and support the plug element.

9. The apparatus of claim 8, wherein the seat is a c-ring.

10. The apparatus of claim 8, wherein the c-ring is a conically-shaped slidable sleeve.

11. The apparatus of claim 8, wherein the seat comprises a variable contact area for engagement with the plug element, the seat having a first contact area for engagement with the plug element in the first position and a second contact area for engagement with the plug element in the second position, the first contact area being smaller than the second contact area so that the second contact area is the plug element support member.

12. The apparatus of claim 11, wherein the plug element support member and the seat are separate structures operatively associated with each other.

13. The apparatus of claim 8, wherein the seat comprises a housing engagement surface, a plug element engagement surface, and a plug element support member engagement surface, the housing engagement surface in sliding engagement with the seat engagement surface, the plug element engagement surface in sealing engagement with the plug element when landed on the seat, and the plug element support member engagement surface being in sliding engagement with the plug element support member, wherein movement of the seat from the first position to the second position causes the housing engagement surface to slide along the seat engagement surface, and the plug element support member to slide along the plug element support member engagement surface to move the plug element support member from a retracted position to an extended position.

14. The apparatus of claim 13, wherein the housing further comprises a housing plug element support member engagement surface in sliding engagement with the plug element support member, wherein movement of the seat from the first position to the second position causes the plug element support member to slide along the housing plug element support member engagement surface to move the plug element support member from the retracted position to the extended position.

15. The apparatus of claim 14, wherein the housing includes an upwardly biased member disposed below the seat to facilitate returning the seat to the first position and the plug element support member to the retracted position.

16. A method of actuating a downhole tool disposed in the wellbore of a well, the method comprising the steps of:

(a) providing a seat disposed within a housing having a longitudinal bore, the seat comprising a plug contact area and a plug element support member disposed below the seat, the seat having a first position and a second position;

(b) lowering the seat and a downhole tool on a string of conduit into a wellbore of a well;

(c) inserting a plug member into the conduit and landing the plug member on the plug contact area of the seat to move the seat from the first position to the second position causing restriction of fluid flow through the conduit;

(d) moving the plug element support member from a retracted position defining a first diameter opening through the plug element support member to an extended position defining a second diameter opening through the plug element support member, wherein the first diameter opening is greater than the second diameter opening and movement of the plug element support member from the retracted position to the extended position allows the plug element to engage the plug element support member;

(e) pumping fluid into the conduit forcing the plug element into the seat; and (f) actuating the well tool by fluid pressure within the conduit.

17. The method of claim 16, wherein step (e) is performed prior to step (d) so that pumping fluid into the conduit moves the plug element support member from the retracted position to the extended position until the plug element support member engages the plug element to provide support to the plug element.

18. The method of claim 17, further comprising the step of reducing the pressure in the conduit after step (f) thereby causing the seat to move from the second position to the first position and, thus, causing the plug element support member to move from the extended position to the retracted position.

* * * * *